US007665402B2

(12) United States Patent
Harrison

(10) Patent No.: US 7,665,402 B2
(45) Date of Patent: Feb. 23, 2010

(54) METHOD OF MANUFACTURING AMMUNITION

(75) Inventor: Leslie Mervyn Harrison, Hocking (AU)

(73) Assignee: Techventure Investments Pty Ltd., The Vines (AU)

( * ) Notice: Subject to any disclaimer, the term of this patent is extended or adjusted under 35 U.S.C. 154(b) by 0 days.

(21) Appl. No.: 12/079,775

(22) Filed: Mar. 28, 2008

(65) Prior Publication Data

US 2008/0257139 A1 Oct. 23, 2008

Related U.S. Application Data

(63) Continuation-in-part of application No. 10/557,321, filed as application No. PCT/AU2005/000473 on Mar. 31, 2005, now Pat. No. 7,448,325.

(30) Foreign Application Priority Data

Mar. 30, 2007 (AU) ..... 2007901728

(51) Int. Cl.
*B21K 21/06* (2006.01)

(52) U.S. Cl. ..... 102/524; 102/374; 102/526; 102/501; 86/54; 86/51

(58) Field of Classification Search ..... 102/374, 102/473, 501, 524, 526; 86/51, 52, 53, 54, 86/55, 56, 57, 1.1
See application file for complete search history.

(56) References Cited

U.S. PATENT DOCUMENTS 26,017 A 11/1859 Cochran
88,689 A 4/1869 Absterdam
293,337 A 2/1884 Mann
1,153,197 A * 9/1915 Craig ..... 164/103
1,481,872 A 1/1924 Miller
2,398,895 A 4/1946 Schreib (Continued)

FOREIGN PATENT DOCUMENTS

AT 404988 4/1999
GB 765502 1/1957

OTHER PUBLICATIONS

International Search Report No. PCT/AU2008/000445 dated Apr. 14, 2008, Techventure Investments Pty Ltd., et al.

(Continued)

*Primary Examiner*—James S Bergin
(74) *Attorney, Agent, or Firm*—Portland Intellectual Property, LLC

(57) ABSTRACT

A method of manufacturing ammunition 10 for firing from the barrel of a weapon comprises forming a mould 32 having an interior surface, placing a core 42 in the mould 32 to produce a casting void 43 and pouring a liquefied solidifiable material into the casting void 43. Upon solidification of the material, the core 42 is removed to produce a projectile body 12 having a closed end and an opposite end. The removal of the core 42 also creates the cavity 18 in the projectile body 12 that opens onto the opposite end. The projectile body 12 is removed from the mould 32 and a quantity of propellant 22 is deposited into the cavity 18 through the opposite end. A seal 26 which incorporates a primer is pressed into the opposite end. Circumferential flanges 30*a* and 30*b* are integrally moulded with the projectile body 12.

25 Claims, 6 Drawing Sheets

U.S. PATENT DOCUMENTS

| | | | | |
|---|---|---|---|---|
| 2,407,264 | A | 9/1946 | Ferrel | |
| 2,684,502 | A | 7/1954 | Paulve | |
| 3,236,184 | A | 2/1966 | Gawlick et al. | |
| 3,349,708 | A | 10/1967 | Withers | |
| 3,424,089 | A | 1/1969 | Humperson | |
| 3,559,581 | A | 2/1971 | Kriz et al. | |
| 4,187,271 | A | 2/1980 | Rolston et al. | |
| 4,378,256 | A | 3/1983 | Watson-Adams | |
| 4,520,731 | A | 6/1985 | Gotz et al. | |
| 4,532,868 | A | 8/1985 | Gleichaut et al. | |
| 4,884,508 | A | 12/1989 | Kruse et al. | |
| H771 | H * | 4/1990 | Cytron et al. | 86/51 |
| 6,234,058 | B1 | 5/2001 | Morgado | |
| 7,448,325 | B2 | 11/2008 | Harrison | |
| 2004/0011237 | A1 | 1/2004 | Khvichia et al. | |

OTHER PUBLICATIONS

International Publication No. WO 2005/095884 Al dated Oct. 13, 2005, (International Application No. PCT/AU12005/000473); Techventure Investments Pty Ltd.

International Search Report No. PCT/AU2005/000473, dated Jul. 4, 2005, Techventure Investments Pty Ltd.

Written Opinion to International Search Report No. PCT/AU2008/000445 dated Apr. 14, 2008, Techventure Investments Pty Ltd., et al.

* cited by examiner

METHOD OF MANUFACTURING AMMUNITION

RELATED APPLICATION

This is a continuation-in-part of U.S. Ser. No. 10/557,321, filed Nov. 18, 2005, now U.S. Pat. No. 7,448,325 which was the National Stage of International Application No. PCT/AU05/00473, filed Mar. 31, 2005.

FIELD OF THE INVENTION

The present invention relates to a method of manufacturing ammunition for firing from the barrel of a weapon, and in particular, but not exclusively, firearm ammunition.

BACKGROUND OF THE INVENTION

A common firearm ball type ammunition, as opposed to shotgun ammunition, comprises a metallic cartridge case containing a volume of propellant, with a primer fixed in a base of the case and a bullet or projectile releasable pressed into an opposite end of the case. When this type of ammunition is in use, a firing pin impacts on the primer which in turn produces a flame to initiate deflagration of the propellant. As the propellant deflagrates inside the case, it produces large volumes of gas which ejects the bullet of projectile from the case, propelling the bullet through the barrel of the weapon from which the ammunition is fired.

The manufacturing process for this type of ammunition is well known and relatively straight forward. Typically, the cases are formed by a stamping or drawing process. A primer is loaded into the base of the cartridge, the cartridge filled with propellant, and the bullet or projectile which is usually made by a casting process pressed into the cartridge.

the present invention proposes a different manufacturing process and produces a different type of ammunition.

SUMMARY OF THE INVENTION

In the claims of this application and in the description of the invention, except where the context requires otherwise due to express language or necessary implication, the words "comprise" or variations such as "comprises" or "comprising" are used in an inclusive sense, i.e. to specify the presence of the stated features but not to preclude the presence or addition of further features in various embodiments of the invention.

According to one aspect of the present invention there is provided a method of manufacturing ammunition for firing from a barrel of a weapon the method comprising:

- forming a mould having an interior surface;
- placing a core in the mould to produce a casting void between the core and the interior surface;
- introducing a liquefied solidifiable material into the casting void;
- removing the core from the body to create a cavity in the body which opens onto the opposite end;
- removing the material from the mould to produce a projectile body having a closed end and an opposite end; and,
- depositing a propellant in the cavity.

The method may further comprise sealing the opposite end with a seal. The seal may comprise a primer.

The method may further comprise forming a seat in the cavity for seating the seal. In one embodiment, forming the seat may comprise configuring one or both of the core and the mould in a manner to produce a seat void into which the liquefied material flows to form, upon solidification, the seat.

In this embodiment the seat void is circular in shape to produce a circular seat or land. In an alternate embodiment, the core may be provided with a plurality of elongated grooves which create rib voids in the cavity, into which the liquefied material flows to form, upon solidification, corresponding ribs along the inside of the cavity. In this embodiment, the seat is formed by ends of the ribs nearest the opposite end.

However in yet a further embodiment the method of forming the seat may comprise placing an insert into the mould, the insert having an open end disposed inside the cavity and inboard of the opposite end, the open end forming a lip inside of the cavity, the lip constituting the seat.

The placing of the insert into the mould may comprise forming an insert, placing the insert on the core, and inserting the core into the mould, wherein, the insert is retained in the projectile body when the core is removed from the projectile body.

The method may further comprise forming a core with a plug and a spigot extending axially from the plug. In this embodiment, the grooves may be formed along the spigot. The forming of the mould may comprise forming the mould from at least two separate parts which can be brought together to produce the casting void, and moved apart to facilitate removal of the projectile body from the mould.

The forming of the mould may further comprise forming the mould with open opposite first and second ends and wherein the placing of the core in the mould comprises inserting the core into the mould from the first end, and introducing the liquefied material comprising pouring the material into the mould from the second end.

One embodiment of the method may further comprise forming one or more circumferential grooves in the interior surface of the mould into which the liquefiable material flows, to form, upon solidification one or more corresponding circumferential flanges about an outside surface of the projectile body. When the projectile is in use, the or each flange engages rifling, and may act as a seal against an inner surface of a barrel of a weapon from which the ammunition is fired. More particularly in one embodiment the method may comprise configuring the mould so that a maximum diameter D1 of body is less than a bore diameter $D_b$ of the barrel. In addition, the circumferential grooves may be formed of a depth so that the corresponding flanges have an outer diameter $D_b < D_2 \leqq D_g (1+\leqq\Delta)$ where $0.05 \geqq \Delta \geqq 0$ and where $D_g$ is a groove diameter of the barrel.

In an alternate embodiment, the mould may be provided with a circumferential ridge about its interior surface which, upon solidification of the liquefiable material, forms a corresponding circumferential groove about the projectile body. This embodiment further comprises the step of engaging a sealing ring in the circumferential groove. In use, the sealing ring can form a seal against an inner circumferential surface of a barrel of a weapon from which the ammunition is fired. In a variation to this embodiment, the circumferential ridge may be one of a plurality of ridges each forming a circumferential groove about the projectile body.

BRIEF DESCRIPTION OF THE DRAWINGS

Embodiments of the present invention will now be described by way of example only with reference to the accompanying drawings in which.

DETAILED DESCRIPTION OF THE PREFERRED EMBODIMENTS

Figure 6:
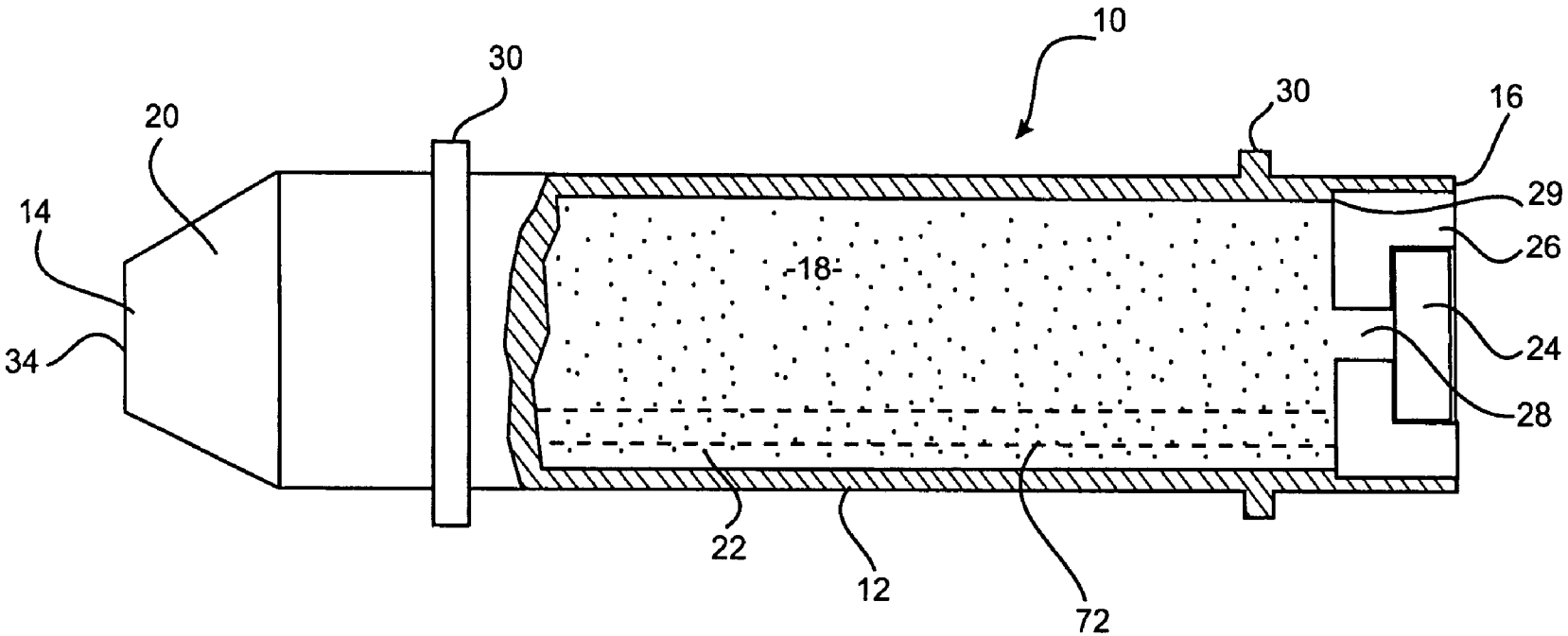
FIG. 6 is a partial cut away view of a round of ammunition manufactured in accordance with an embodiment of the present invention.

Embodiments of the present method facilitate the manufacture of ammunition of the type described in Applicant's co-pending international publication no. WO 2005/095884. An embodiment of a round of ammunition 10 is depicted in FIG. 6 which shows a projectile body 12 comprising a first (leading) end 14 and a second trailing, axially opposed end 16. An internal cavity 18 is formed between the ends 14 and 16 and holds a volume of a propellant 22. The first end 14 is closed by a nose 20 that is formed integrally with the body 12. End 16 is sealed with a base seal 26 that includes a primer 24 for igniting the propellant 22. A flame from the primer 24 is directed through a flash hole 28 formed in the base seal 26. The base seal 26 is pressed onto a seat 29 formed inside the body 12. Seals 30 in the form of circumferential flanges are provided about the body 12 for maintaining gas pressure of deflagrating propellant. In particular, the seals 30 form a seal against an inner circumferential surface (i.e., the groove diameter) of a barrel of a weapon from which the ammunition 10 is fired. Typically this would be the barrel of a firearm. The ammunition 10 is caseless ammunition in that the propellant is held entirely with the projectile body 12 and there is no case or cartridge holding any propellant on to which the projectile body is attached.

Figures 1A, 1B, 1C, 1D:
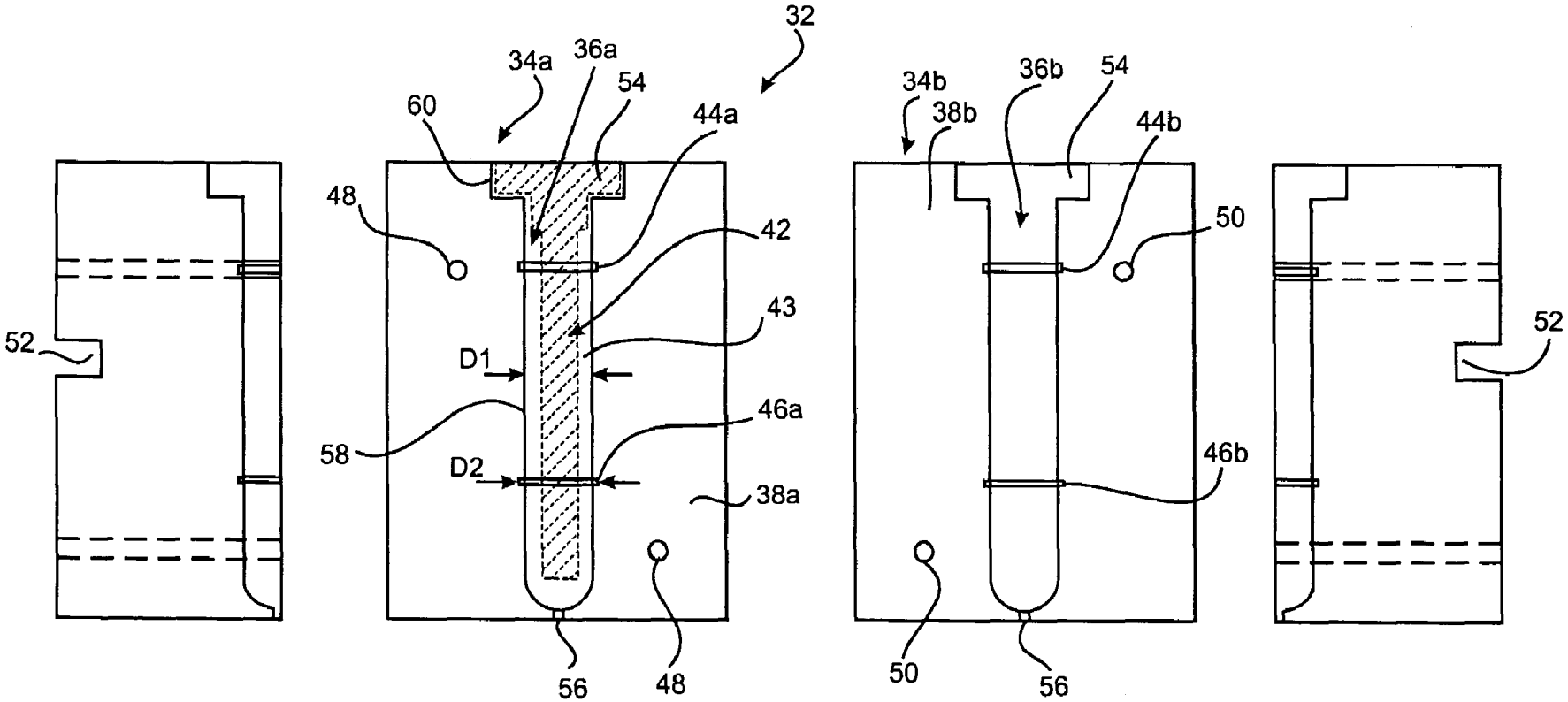
FIG. 1*a* is a side elevation of a left half of a mould used in an embodiment of the present method of manufacturing a projectile.
FIG. 1*b* is a front elevation view of the left hand mould shown in FIG. 1*a;*
FIG. 1*c* is a front elevation view of a right half of the mould.
FIG. 1*d* is a side elevation of the right half of the mould shown in FIG. 1*c;*
Figure 2:
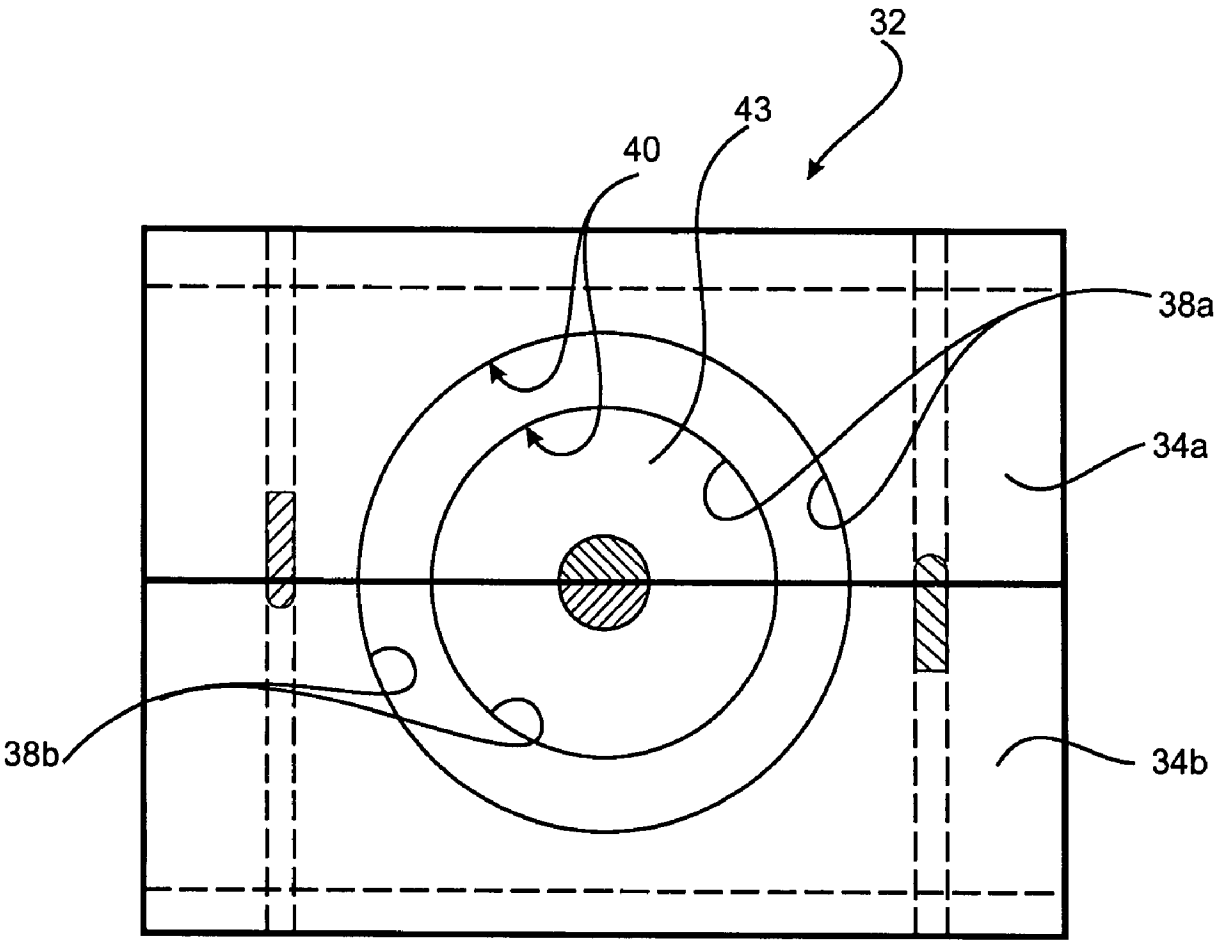
FIG. 2 is an end elevation of the mould with the right and left halves shown in FIG. 1 put together.

FIGS. 1*a*-2 depict an embodiment of a mould 32 incorporated in the present method for manufacturing the ammunition 10. FIGS. 1*a* and 1*b*; and, FIGS. 1*c* and 1*d* depict left and right side portions 34*a* and 34*b* (hereinafter referred to in general as "portions 34) respectively of the mould 32. The portions 34 have mirror image configurations. The portions 34*a* and 34*b* are provided with recesses 36*a* and 36*b* (referred to in general as "recesses 36") in their respective surfaces 38*a* and 38*b*. When the portions 34 are brought together to form the mould 32 respective surfaces 38*a* and 38*b* form an interior surface 40 of the mould 32.

The interior surface 40 is in a general configuration complimentary to the exterior shape of the projectile body 12. In order to form the cavity 18 in the projectile body 12 a core 42 (see FIGS. 1*a*, 3*a* and 3*b*) is inserted into the mould 32. In particular, placing the core 42 in the mould 32 results in the formation of a casting void 43 (one half of which is shown in FIG. 1*b* between the core 42 and the interior surface 40.

In the illustrated embodiment, the interior surface 40 of the mould 32 is formed with two circumferential grooves, formed by semicircular grooves 44*a* and 44*b* and the other by semicircular grooves 46*a* and 46*b*. Semicircular grooves 44*a* and 44*b* in the mould portions 34*a* and 34*b* together form one of the circumferential grooves in the interior surface 40 while the semicircular grooves 46*a* and 46*b* in the mould portions 34*a* and 34*b* when brought together form a second circumferential groove in the interior surface 40. A liquefied solidifiable material such as molten lead is poured into the mould 32 and flows into the casting void 43, including the grooves, to form the body 12 and circumferential flanges, which act as seals 30*a* and 30*b* extending about the projectile body 12 shown in FIG. 6.

The mould portion 34*a* is formed with a pair of semicircular dimples 48 which are diametrically opposed about the recess 36*a*. The mould portion 34*b* is formed with a pair of hemispherical recesses 50 diametrically opposed about the recess 36*b*. The dimples 48 and recesses 50 are relatively located so as to register with each other when the portions 34 are brought together to form the mould 32. Channels 52 are formed in a side of the portions 34 opposite the surfaces 38*a*, 38*b* for seating a spring or clamp to hold the portions 34 together while the molten lead is poured into the mould 32.

As is apparent from FIGS. 1*a*-1*d*, the mould 32 is formed with open opposite ends 54 and 56. The core 42 is inserted into the end 54 prior to the introduction or pouring of molten lead into the mould 32. The mould 32 is then orientated so that the casting void 43 is vertically disposed with the end 54 lowermost and supported on a surface. Each recess 36 has a major length 58 extending from the end 56 toward the end 54 of constant diameter which leads to a step wise increased diameter part 60 that opens onto the end 54.

Figure 3B:
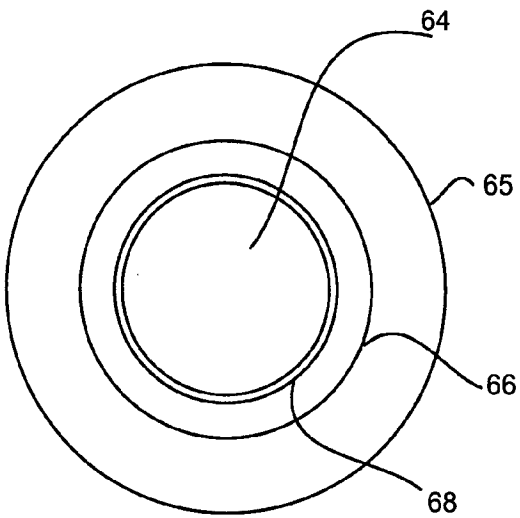
FIG. 3*b* is an end elevation view of the core shown in FIG. 2*a;*
Figure 3A:
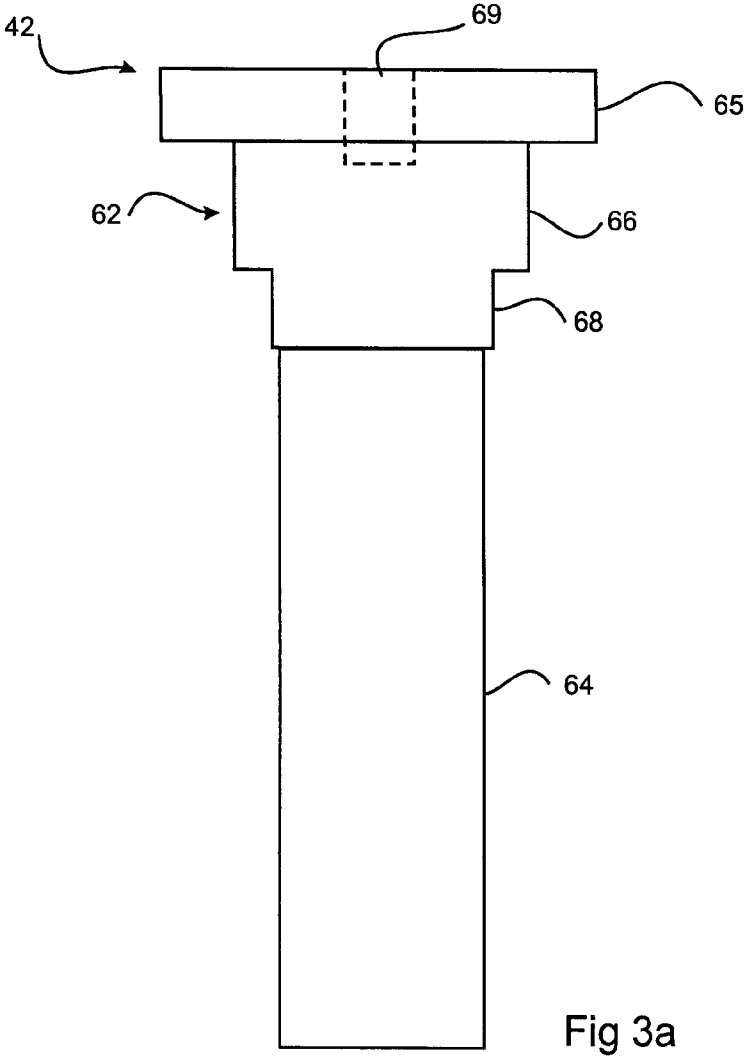
FIG. 3*a* is a side elevation view of a core incorporated in an embodiment of the method.

FIGS. 3*a* and 3*b* depict an embodiment of the core 42 comprising a plug 62 and a spigot 64 extending coaxially from the plug 62. The plug 62 has a base 65 of a configuration so as to seat in the increased diameter part 60 and abut against circumferential and radial surfaces of the part 60. The plug 62 further includes a reduced diameter portion 66 that is dimensioned to extend into and abut against a corresponding length of an inner circumferential wall of the part 58 of each recess 36. The base 65 and reduced diameter portion 66 in effect seal the open end 54 of the mould 32. This substantially closes the end 54 to prevent or substantially minimise leakage of molten lead.

Extending from the portion 66 is a further step wise reduced diameter portion 68. The spigot 64 extends coaxially with the portion 68 and has a slightly smaller diameter. The difference in the diameter between the portion 68 and the spigot 64 forms the seat 29 in the projectile body 12 (see FIG. 6).

To facilitate easy removal of the core 42 from the projectile body 12 the spigot 64 is provided with a slight taper so as to reduce in outer diameter in a direction away from the plug 62. A blind hole 69 is formed in the base 65 coaxial with the spigot 64. The hole 69 receives a tool to assist in gripping and thus extracting the core 42 from the body 12.

A typical sequence of events in the manufacture of the projectile 10 is as follows:

(a) bring the mould portions 34 together with the dimples 48 seated in the hemispherical seats 50 and then clamp the portions 34 together by a clamp or spring seated in the grooves 52;

(b) insert the core 42 into the mould 32 from the open end 54 seating the plug 62 and in particular the base 65 in the increased diameter portion 60 of the recess 36 to thereby form the casting void 43 between the core 42 and the interior surface 38;

(c) introduce (i.e. pour) the liquefied solidifiable material such as molten lead into the casting void;

(d) upon or just prior to solidification of the molten lead, remove the core 42 from the projectile body 12 to create a cavity 18 in the body 12 which opens onto an open end 16 of the body 12;

(e) separate the mould portions 34 and remove the projectile body 12;

(e) depositing a quantity of propellant 22 into the cavity 18;

(f) press the seal 26 into the body 12 onto the seat 29 to seal the end 16.

However in a minor variation the core could be removed after opening the mould to remove the body, ie step (3) could be performed before step (4).

Figure 4B:
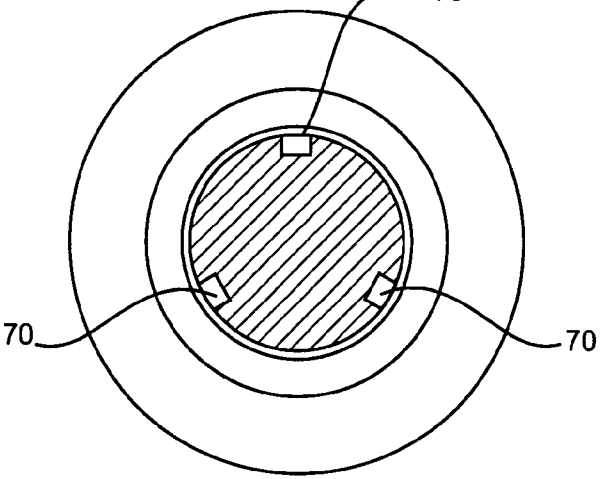
FIG. 4*b* is an end elevation view of the core shown in FIG. 4*a;*
Figure 4A:
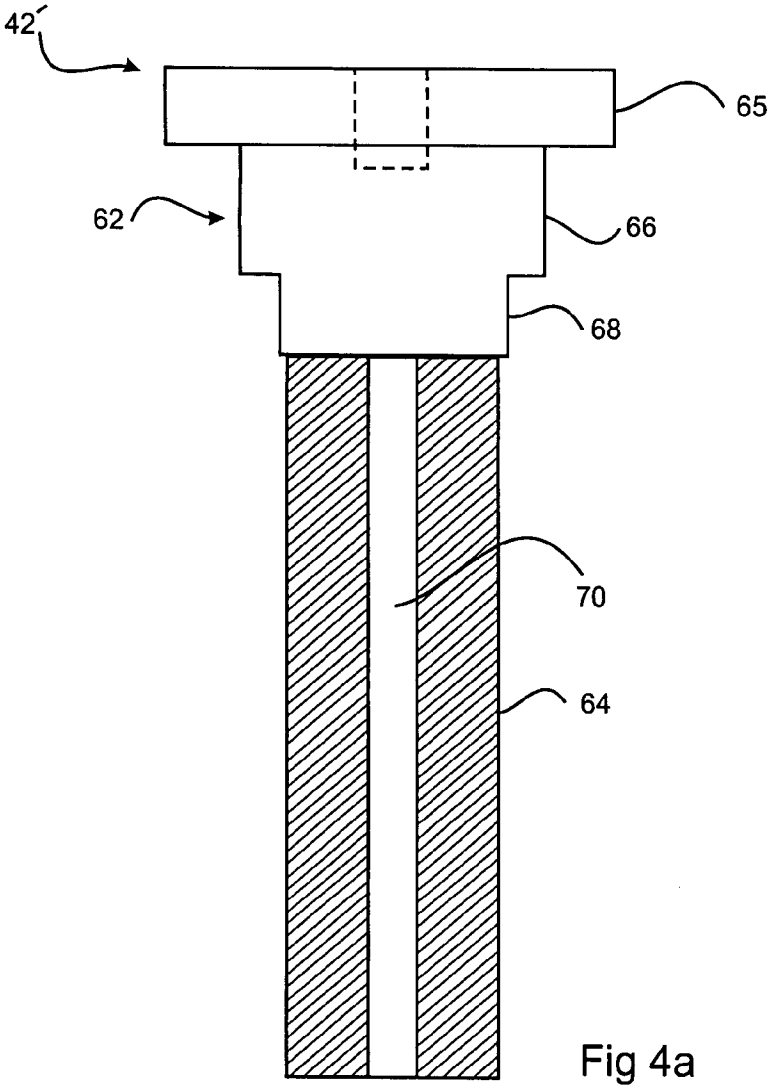
FIG. 4*a* is a side elevation of a core incorporated in a further embodiment of the method.

FIGS. 4*a* and 4*b* depict an alternate form of the core, denoted herein as core 42' that may be used in an alternate embodiment of the present method. The core 42' is identical with the core 42 with the exception of the inclusion of three elongate and evenly spaced grooves 70 that extend along the length of the spigot 64. The grooves 70 create rib voids in the casting cavity 43 into which molten lead flows to form, upon solidification, corresponding integrally formed ribs 72 (shown in phantom in FIG. 8) along the inside of the cavity 18 in the projectile body 12. The ribs 72 form two functions. Firstly, they provide increased strength to the projectile body 12, and secondly, ends of the ribs 72 nearest the end 16 act as lands which together form an alternate configuration seat 29 for the seal 26. Thus, in this embodiment, the method creates a seat which, instead of being a ring like structure comprises three lands onto which the seal 26 can be pressed.

Figure 5B:
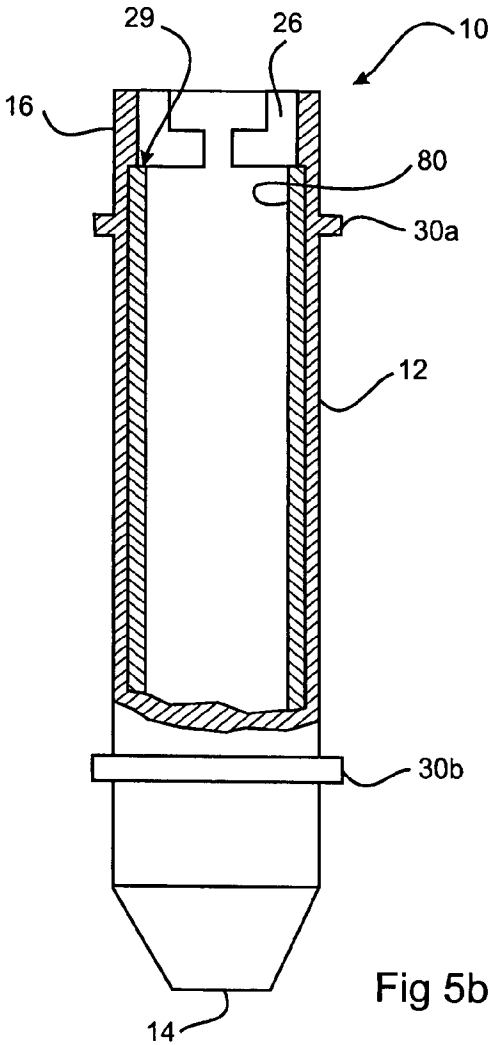
FIG. 5*b* is a partial section view of a round of ammunition manufactured using the core and insert shown in FIG. 5*a*.
Figure 5A:
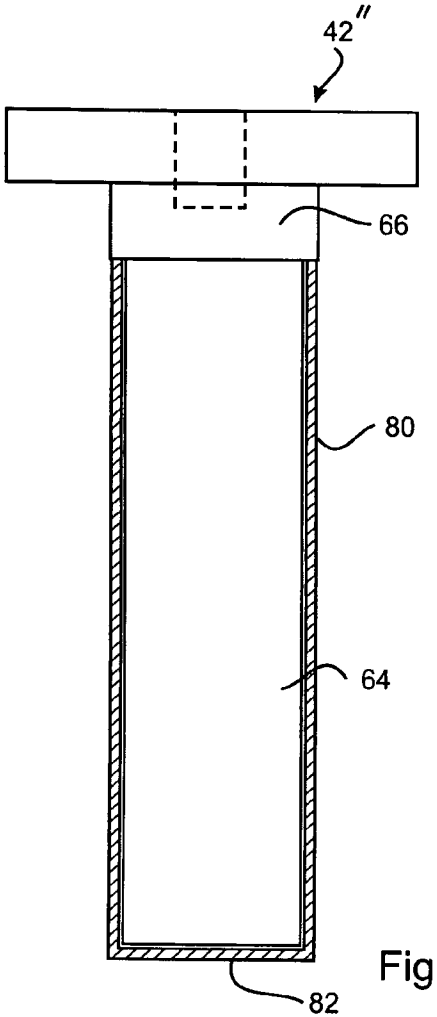
FIG. 5*a* is a schematic representation of a core and insert that may be used in a further embodiment of the method.

FIGS. 5*a* and 5*b* depict a variation in the method by which an insert or sleeve 80 in the form of a cylindrical tube having a closed end 82 is moulded into the ammunition 10. The insert 80 is carried by a modified core 42". The core 42" differs from the core 42 by omission of the reduced diameter part 68 so that the spigot 64 extends directly from the reduced diameter portion 66. The core 42" with the insert 80 carried on the spigot 64 is inserted into the mould 32. After the molten lead has solidified, and the core 42" is extracted leaving the insert 80 inside the body 12 as depicted in FIG. 5*b*. A rim of the open end of the insert 80 may also act to form the seat 29. As shown in FIG. 5*b* an upper portion of the body 12 near end 16 may have a thickened wall and partially overhang the upper end of the insert 80, still leaving the seat 29 for the seal 26. Although in an alternate embodiment the wall of the body 12 may be of substantially uniform width with no overhand of the upper (open) end of the insert 80.

An advantage of using the insert 80 is that it may be made from a stronger material than that used for the body 12, for example high tensile steel) providing greater strength to the body 12 for the purposes of confining deflagrating propellant. In particular, the sleeve will minimise radial expansion of the body 12 to reduce the likelihood of the outer surface of the body 12 contacting the rifling in a barrel after commencement of deflagration. The mould 32 may be configured to have an inner diameter D1, corresponding to a maximum outer diameter of the body 12, which is less than or equal to a bore diameter of a weapon from which the ammunition 10 is to be fired, and an inner diameter D2, corresponding to the outer diameter of the seals 30*a*, 30*b*, between a minimum which is at least greater than the bore diameter and a maximum which is greater than a groove diameter of the weapon. Thus, for example, if the bore diameter is signified as $D_b$ and the groove diameter as $D_g$, then $D1 \leqq D_b$ and $D_b < D_2 \leqq D_g(1+\Delta)$ where $0.05 \geqq \Delta \geqq 0$. In this way, prior to firing the ammunition 10, the ammunition 10 will have a body 12 of a maximum diameter less than or at most equal to the bore diameter, and seals 30*a*, 30*b* will have a diameter that will engage the rifling and also engage the groove diameter of the weapon. When the seals 30*a*, 30*b* engage the groove diameter and the rifling, a seal is formed which substantially eliminates the escape of high pressure gas past the ammunition 10. Indeed in a further embodiment the seals may have different diameters to each other. For example, the seal 30*b* may have a diameter equal to the groove diameter $D_g$ with the rear seal 30*a* having a diameter equal to or marginally less than a breach diameter. In this way the real seal 30*a* will centrally position the ammunition with respect to a central axis of the barrel.

In embodiments where the insert 80 is incorporated in the method of manufacturing, after firing of the ammunition 10, the insert 80 may confine radial expansion of the ammunition 10 as it travels along the barrel of the weapon to the extent that D1 is always less than the bore diameter so that the outer surface of the body does not have any substantive contact with the rifling. This minimises drag in the barrel and maximises thrust produced by the propellant.

In the above discussion the term "bore diameter" is intended to define the internal diameter of a barrel measured from the tops of diametrically opposed lands forming the rifling, ie the smallest internal diameter. If the lands are not opposed, then the bore diameter is the diameter of a circle inscribed to touch the top of the lands. The bore diameter is the inside diameter of the barrel before the rifling is cut. The term "groove diameter" is intended to define the diametrical measurement of the bore of a rifled barrel, measured from the bottom of opposing grooves (ie the largest internal diameter). If the grooves are not opposed, the groove diameter is deemed to be the diameter of a circle inscribed to touch the bottoms of the grooves. Now that embodiments of the invention have been described in detail it will be apparent to those skilled in the relevant arts that numerous modifications and variations may be made without departing from the basic inventive concepts. For example, the method described depicts the manufacture of a mould 32 having a single casting cavity 40. However a mould 32 may be formed with any number of cavities so as to form multiple projectile bodies 12 from a single mould. Alternately, a plurality of separate moulds 32 each having a single casting cavity 40 may be cast simultaneously to again form multiple projectile bodies 12 in a single casting step. FIGS. 5*a* and 5*b* depict the use of an insert 80 having one open end and a closed end 82. However in an alternate embodiment, both ends of the insert 80 may be open. Further, while the liquefied solidifiable material is described in the specification as being lead, other materials could be used including for example various metals and alloys such as aluminium, steel, and brass; rubbers; or settable plastics and resins. The use of an insert 80 may provide further benefits when the liquefiable material is a plastics material or a rubber material in protecting the body 12 from being consumed by the deflagrating propellant.

All such modifications and variations together with others that would be obvious to a person of ordinary skill in the art are deemed to be within the scope of the present invention the nature of which is to be determined from the above description and the appended claims.

The claims defining the present invention are as follows:

1. A method of manufacturing a caseless projectile for firing from a barrel of a small arms weapon the method comprising:

forming a mould having an interior surface;

placing an insert having an open end on a core and placing the core in the mould to produce a casting void between an exterior surface of the insert and the interior surface;

introducing a liquefied solidifiable material into the casting void;

the mould and core being shaped wherein upon removing the core, a projectile body is formed having a closed nose, and an opposite open end, with the insert being retained in the projectile body, an interior of the insert forming a cavity which opens onto the opposite open end;

removing the projectile body from the mould; and, depositing a propellant in the insert.

2. The method according to claim 1, further comprising forming one or more circumferential grooves in the interior surface of the mould into which the liquefiable material flows, wherein, upon solidification one or more corresponding circumferential flanges are integrally formed about an outside surface of the projectile body.

3. The method according to claim 2, comprising configuring the mould so that a maximum diameter Dl of the projectile body is less than a bore diameter $D_b$ of the barrel.

4. The method according to claim 3, comprising forming the circumferential grooves of a depth so that the corresponding flanges have an outer diameter $D_2$ where $D_b<D_2\leqq D_g(1+\Delta)$ and where $0.05\geqq\Delta\geqq 0$ wherein $D_g$ is a groove diameter of the barrel.

5. The method according to claim 1, comprising forming said insert of a material having greater hoop strength than the body.

6. The method according to claim 1, comprising utilising the open end of the insert as a seat and sealing the opposite end of the body by inserting a primer onto said seat.

7. The method according to claim 1, wherein forming the mould comprises forming the mould from at least two separate portions, each of the portions extending for a length greater than a length of the projectile body and wherein the portions can be brought together to produce the casting void, and moved apart to facilitate removal of the projectile body from the mould.

8. A method of manufacturing a caseless projectile for firing from a small arms weapons the method comprising:

providing a mould comprising two portions which when brought together form an interior surface of mould, the portions each provided with at least one semi circular groove, the grooves on the portions being aligned so as to together form at least one circumferential groove in the internal surface;

placing a core in the mould to produce a casting void between the core and the interior surface;

introducing a liquefied solidifiable material into the casting void; and relatively shaping the mould and the core and solidifying the liquified material introduced into the casting void so as to define a projectile body that includes a closed nose at a forward end of the body, an opposite open end and at least one circumferential flange defined by the liquified material flowing into the at least one circumferential groove.

9. The method according to claim 8, further comprising placing an insert into the mould, the insert having an open end disposed inside the cavity and inboard of the opposite open end, whereby the insert is moulded into said body and defines said cavity.

10. The method according to claim 9, comprising forming said insert of a material having greater hoop strength than the body.

11. The method according to claims 10, further comprising sealing the opposite open end with a seal.

12. The method according to claim 9, wherein placing the insert in the mould comprises placing the insert on the core, and inserting the core into the mould, wherein, the insert is retained in the projectile body when the core is removed from the projectile body.

13. The method according to claim 9, further comprising utilising the open end of the insert as a seat and sealing the opposite open end of the body by inserting a primer onto said seat.

14. The method according to claim 8 comprising removing the core by withdrawing the core from the open opposite end of the projectile body.

15. A method of manufacturing a caseless projectile for firing from a small arms weapons, the method comprising:

forming a mould having an interior surface and an opening at a first end;

placing a core into the opening in the mould to produce a casting void between the core and the interior surface, the core having adjacent, step-wise reduced diameter portions;

introducing a liquefied solidifiable material into the casting void;

relatively shaping the mould and core and solidifying the liquified material introduced into the casting void so as to define a projectile body that includes a closed nose, an opposite open end and a seat in the open end defined by said reduced diameter portions; and seating a seal on the seat so as to seal the open end.

16. The method according to claim 15, wherein said steps of relatively shaping and solidifying together with a step of removing the core from the projectile body produce in the projectile body a cavity which opens onto the opposite end, further comprising depositing a propellant in the cavity, and providing the seal with a primer for igniting the propellant.

17. The method according to claim 16, further comprising placing an insert into the mould, the insert having an open end disposed inside the cavity and inboard of the opposite open end, wherein the insert is moulded into said body and defines said cavity.

18. The method according to claim 17, comprising forming said insert of a material having greater hoop strength than the body.

19. The method according to claim 17, wherein placing the insert in the mould comprises placing the insert on the core, and inserting the core into the mould, wherein the insert is retained in the projectile body when the core is removed from the projectile body.

20. The method according to claim 19, comprising sealing the open opposite end with a primer the primer being arranged to initiate deflagration of the propellant.

21. The method according to claim 20, comprising forming a seat in the cavity for seating the primer.

22. The method according to claim 16, wherein forming the mould comprises forming the mould with an opening at a second end opposite the first end of the mould, and wherein introducing the liquefied material comprises pouring the material into the mould from the opening at the second end.

23. The method according to claim 16, comprising relatively shaping the mould and core so that the nose has a diameter less than the diameter of the opposite open end of the projectile body.

24. The method according to claim 16, wherein the mould comprises two portions which when brought together form the interior surface, the portions each provided with at least one semi circular groove, the grooves on the portions being aligned so as to together form at least one circumferential groove in the internal surface, wherein the liquified solidifiable material flows into the at least one circumferential groove, and wherein said steps of relatively shaping and solidifying produce in the projectile body at least one circumferential flange defined by the liquified material flowing into the at least one circumferential groove.

25. The method according to claim 24, wherein the portions are provided with at least two of the semi circular grooves, wherein said steps of relatively shaping and solidifying define, respectively, at least two of the circumferential flanges, a first one of the flanges being near the nose and a second one of the flanges being near the opposite open end, and wherein the outer diameter of the second flange is greater than the outer diameter of the first flange.

* * * * *